US007128497B2

(12) United States Patent
Daluise

(10) Patent No.: US 7,128,497 B2
(45) Date of Patent: Oct. 31, 2006

(54) HORIZONTALLY DRAINING ARTIFICIAL TURF SYSTEM

(76) Inventor: Daniel A. Daluise, 11 Skylar Dr., Southborough, MA (US) 01772

( * ) Notice: Subject to any disclaimer, the term of this patent is extended or adjusted under 35 U.S.C. 154(b) by 0 days.

(21) Appl. No.: 11/002,716

(22) Filed: Dec. 2, 2004

(65) Prior Publication Data

US 2005/0238433 A1 Oct. 27, 2005

Related U.S. Application Data

(63) Continuation-in-part of application No. 10/869,063, filed on Jun. 17, 2004.

(60) Provisional application No. 60/567,085, filed on Apr. 30, 2004, provisional application No. 60/526,371, filed on Dec. 2, 2003, provisional application No. 60/520,185, filed on Nov. 15, 2003.

(51) Int. Cl.
*E02B 11/00* (2006.01)

(52) U.S. Cl. ..... 405/43; 405/45; 405/50

(58) Field of Classification Search ..... 405/43, 405/45, 46, 50; 52/169.5, 169.2; 428/137, 428/167

See application file for complete search history.

(56) References Cited

U.S. PATENT DOCUMENTS 4,943,185 A * 7/1990 McGuckin et al. ..... 405/45
5,091,234 A * 2/1992 McGroarty et al. ..... 428/143
5,094,569 A * 3/1992 Fleming ..... 405/258.1
5,205,068 A * 4/1993 Solomou ..... 47/56
5,287,650 A * 2/1994 Moriguchi et al. ..... 47/59 R
6,135,672 A * 10/2000 Davidson ..... 405/19
6,247,874 B1 * 6/2001 Hu ..... 405/43
6,658,790 B1 * 12/2003 Skuba ..... 47/56
6,691,472 B1 * 2/2004 Hubert ..... 52/169.5
6,736,568 B1 * 5/2004 Pugh et al. ..... 405/43
6,857,818 B1 * 2/2005 Bussey et al. ..... 405/38
6,877,932 B1 * 4/2005 Prevost ..... 405/38
2003/0118405 A1 * 6/2003 Sakamoto ..... 405/46

FOREIGN PATENT DOCUMENTS

JP 08228617 * 9/1996

* cited by examiner

*Primary Examiner*—Frederick L. Lagman
(74) *Attorney, Agent, or Firm*—John H. Pearson, Jr., Esq.; Walter F. Dawson, Esq.; Pearson & Pearson, LLP

(57) ABSTRACT

A horizontally draining artificial turf system comprises an impervious base at proper slope, an impermeable layer or drainage blanket over the base at a corresponding slope for guiding water horizontally, an artificial turf at top of the impermeable layer, and a perforated pipe near the lower edge of the base for receiving water for evacuation. Rainwater over the artificial turf first drains vertically onto the impermeable layer and then flows along the impermeable layer to reach the perforated pipe, without infiltrating into the base. Alternatively, a partially pervious drainage blanket is provided in lieu of the impermeable layer where the base is partially pervious. Backup rainwater runs off the drainage blanket horizontally after it saturates the soils of the base.

22 Claims, 5 Drawing Sheets

HORIZONTALLY DRAINING ARTIFICIAL TURF SYSTEM

CROSS REFERENCE TO RELATED APPLICATIONS

This application claims benefit and priority from provisional application No. 60/526,371, filed on Dec. 2, 2003, entitled, "Horizontally Draining Artificial Turf System," which is incorporated by reference herein in its entirety. This application also claims benefit and priority from provisional application No. 60/567,085, filed on Apr. 30, 2004, entitled, "Method for Turf Installation Utilizing Micromechanical Bonding," which is incorporated by reference herein in its entirety. This application is also a continuation in part (CIP) of application Ser. No. 10/869,063, Jun. 17, 2004, entitled, "Method of Manufacturing Synthetic Turf," which is incorporated by reference herein in its entirety and which claims priority to provisional application No. 60/520,185 Nov. 15, 2003 which is also incorporated by reference herein in its entirety.

FIELD OF THE INVENTION

The present general inventive concept relates to artificial playing surfaces for athletic games. More particularly, the present general inventive concept relates to horizontally and/or vertically draining water from artificial turf.

BACKGROUND OF THE INVENTION

Vertically draining artificial turfs, commonly called "infilled turf", and as embodied in U.S. Pat. Nos. 4,337,283 and 5,976,645 and others, represent a great improvement over the original short-pile artificial playing surfaces in that they reduce abrasiveness, increase shock attenuation, improve response to foot and ball actions, and have an improved appearance.

Because these turf systems drain vertically, it was necessary to construct a vertically draining stone base, which could infiltrate water from the surface at a rate greater than the rainfall rate expected in a large rainstorm. To accomplish this, it was necessary to build the base with a high infiltration rate. However, such base was less stable, especially with regard to maintaining the high tolerance finish grade, throughout the life out of the turf. As a result, either the infiltration rate or stability of the stone base was composed.

For those reasons, there is a need for constructing artificial turfs that allow rainwater to evacuate at sufficiently large capacity without compromising the structure of the base.

SUMMARY OF THE INVENTION

It is an aspect of the present general inventive concept is to provide an artificial turf, which allows rainwater to evacuate efficiently without infiltrating its stone base, thereby increasing the stability of the base.

Another aspect of the present general inventive concept is to provide an artificial turf that is easy to maintain, thereby reducing the maintenance costs. Yet another aspect of the present general inventive concept is to provide a method for constructing artificial turf that has a horizontally draining system.

The above aspects can be obtained by an apparatus that includes (a) a sloped blanket beneath a horizontal permeable turf layer to direct water; and (b) a main drainage system to collect the water directed from the sloped blanket.

The above aspects can also be obtained by an apparatus that includes (a) a core made of water-resistant material; (b) a top layer made of permeable material; and (c) expansion joints located throughout the blanket.

The artificial turf system of the present general inventive concept comprises a base made of cementations or limestone derivatives or soil aggregates, a permeable or perforated artificial turf at top, and an impermeable drainage blanket between the base and the artificial turf. The turf is constructed with a sufficient slope, and at least one of lower edges of the artificial turf is connected to or close to a perforated pipe in connection with a main drainage system. Therefore, the rainwater first drains vertically from the artificial turf to reach the drainage blanket, and then drains horizontally along the drainage blanket to reach the perforated pipe and the main drainage.

The drainage blanket is a piece of solid slab containing sufficiently large and properly distributed continuous void, allowing water to flow in at least one direction. Alternatively, it may consist of a rigid solid cupsated core, covered by one or more water impermeable sheets. To build a large artificial playing field, two or more pieces of drainage blankets may be jointed by a watertight seam so that water cannot pass through the joint to reach the base. In this way, a monolithic full area impermeable drainage blanket is created.

The present general inventive concept provides a method for quickly and economically constructing an artificial turf playing field, which has reduced engineering risks and increased water evacuation capacities. The method is especially useful when poor soils or unfavorable site drainage conditions are encountered. In addition, a method is provided for determining the necessary water-evacuating capacity for a given artificial turf system, therefore reducing engineering risks.

The artificial turf system of the present general inventive concept has one or more of the advantages. In one aspect, rainwater does not get into the base of the invented artificial turf system, and therefore, the infiltration property of the base is no longer necessary provided that the entire drainage blanket has been designed with a sufficient flow capacity to provide the required evacuation rate. In another aspect, when an impermeable drainage blanket is used, the base is better protected and its installation life is extended.

In yet another aspect, the drainage blanket under the artificial turf system may act as an excellent shock attenuation pad. By designing the structure of the drainage blanket, different degrees of the shock attenuation may be achieved. Finally, when the base is constructed by missing onsite soils with a soil stabilizer to form a strong, durable and water-impervious base, it is unnecessary to excavate, export or import soils to or from the site, thereby reducing construction costs and time. Incorporation of the soil stabilizer in the base also increases the stability of the base and the playing field.

Those and other aspects of the present general inventive concept will become apparent to those skilled in the art after a reading of the following detailed description of the general inventive concept together with the following drawings.

DETAILED DESCRIPTION OF THE INVENTION

Figure 1:
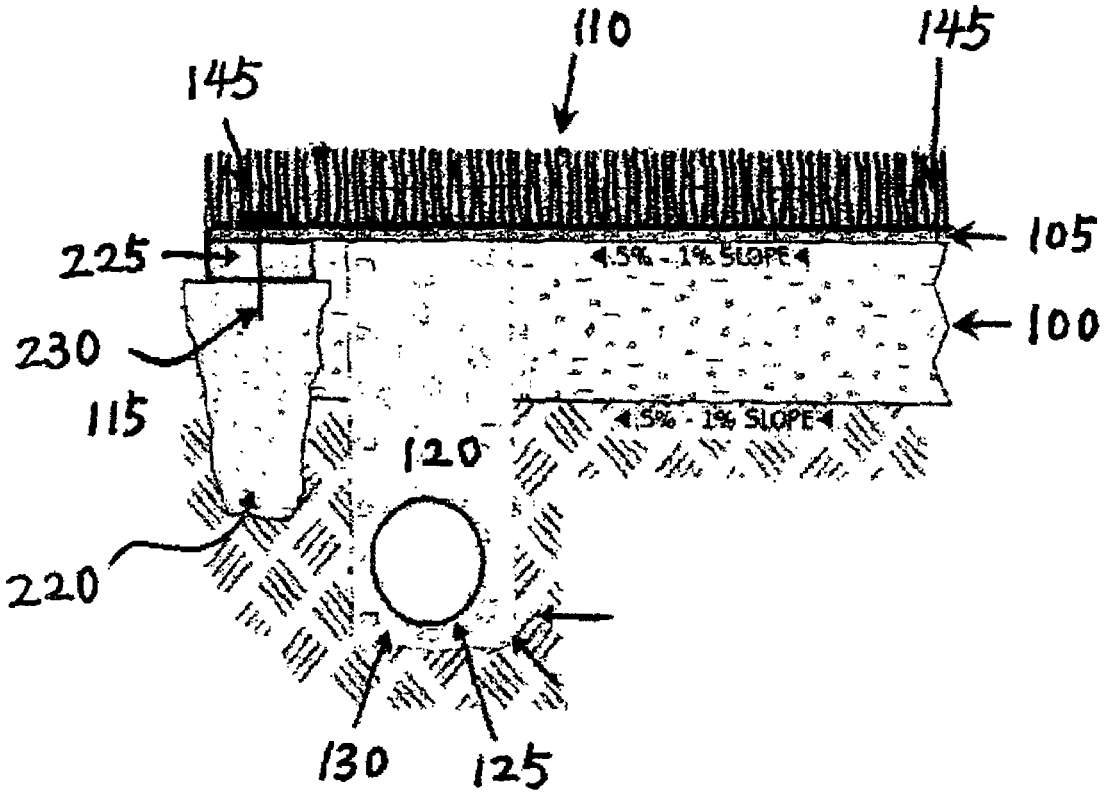
FIG. 1 is a cross-sectional view of the structure of the vertically draining artificial turf system, according to an embodiment.

FIG. 1 is a cross-sectional view of the structure of the vertically draining artificial turf system, according to an embodiment.

In an embodiment of the present general inventive concept, the horizontally draining artificial turf system can include a base 100 built with a sufficient degree of slope, a drainage blanket 105 above the base 100, an artificial turf 110 over the drainage blanket 105, fastening mechanism 115 to attach the artificial turf 110 onto the base 100, and a draining apparatus 120, which is situated near and below the lower edge of the base 100. the artificial turf is 110 is water permeable or perforated, allowing water to drain vertically to reach the drainage blanket 105. The draining apparatus 120, consisting of a perforated pipe 125 and surrounding washing sands or stones 130, is directly under the opening or perforated edge of the drainage blanket 105 near the lower edge of the base 100 so that the water from the drainage blanket 105 is able to flow into the perforated pipe 125 to reach the main drainage system (not shown). Where the base (or portions of the base) is supposed to allow water to pass, these portions can be made of a water permeable material. This can be an aggregate material, such as stone, rocks, a combination of stone and rocks, sand, permeable concrete, as well as existing drainage systems.

The artificial turf 110 can be a conventional artificial turf or an improved artificial turf. The main drainage system can be located in a center (and below) the turf, or on a perimeter of the turf (on either, some, or all sides of the field or extending beyond the field). Thus, the drainage blanket 105 can be sloped towards the center of the field, in which water flows to a center (and thereafter below) the turf, or the drainage blanket 105 can be sloped away from the center of the field, and thus water flows towards to perimeter (and perhaps beyond) of the field.

Figure 2:
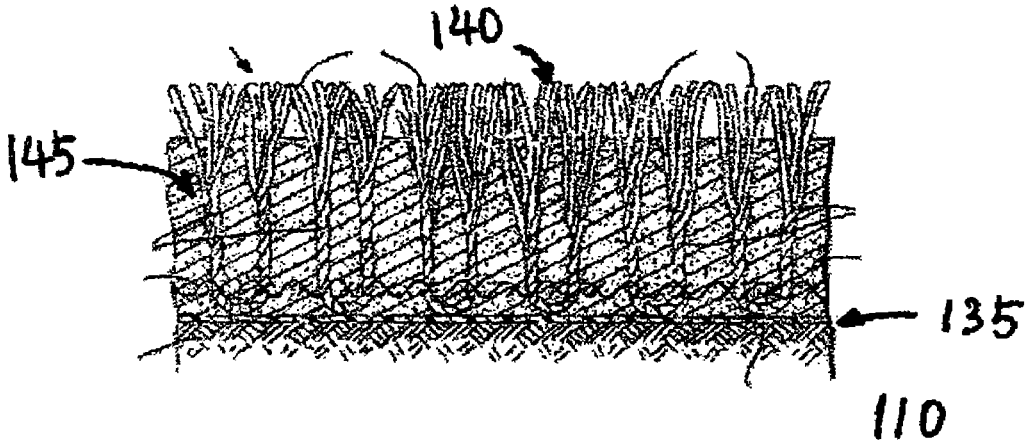
FIG. 2 is a cross-sectional view of the conventional artificial turf, according to an embodiment.

FIG. 2 is a cross-sectional view of the conventional artificial turf, according to an embodiment.

A conventional artificial turf can include a backing 135 made of a woven or non-woven sheet material, a pile fabric 140 tufted in the backing 135, and, optionally, an infill 145 which is a resilient granular material. To make the pile fabric 140, yarns of single or plural fiber filaments are looped into and back out the backing 135 and are cut to the same length as shown in FIG. 2.

Figure 3:
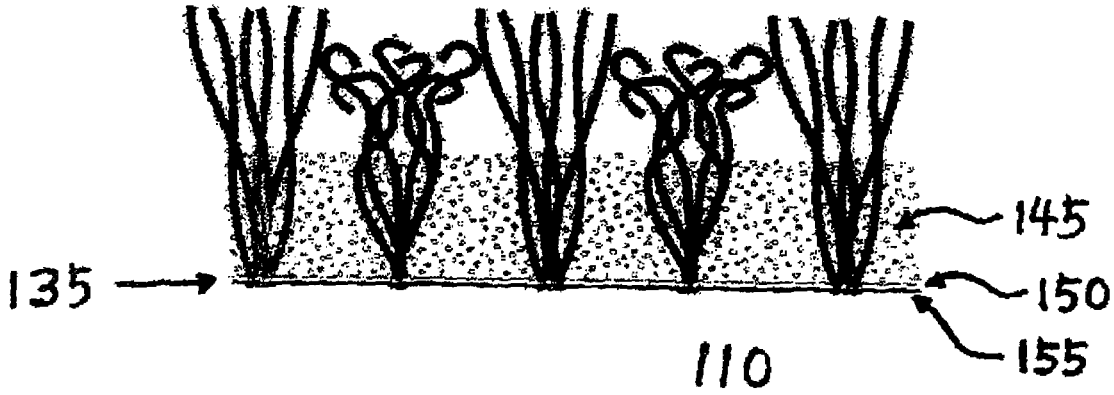
FIG. 3 is a cross-sectional view of improved artificial turf containing straight and curled yarns in an alternative stitch line configuration, according to an embodiment.

FIG. 3 is a cross-sectional view of improved artificial turf containing straight and curled yarns in an alternative stitch line configuration, according to an embodiment.

An improved artificial turf can include a backing 135, a pile fabric 140, and optionally an infill 145 in the space between the filaments of the pile fabric 140. The pile fabric 140 comprises curled and straight yarns tufted in the backing 135 in alternative stitch lines.

The backing 135 consists of a primary backing 150 and a secondary backing 155, and is sufficiently permeable, or has plural holes (now shown) if it is made of an impermeable material to allow water to pass onto the drainage blanket 105. The primary backing 150 may be made one of to three layers of woven and/or non-woven fabrics. Generally these fabrics are polypropylene, polyester or other synthetic materials. While a two-layer backing is feasible, the preferred construction is three layers with the outside layers comprised of a woven, fibrated (fleeced) material known in the trade as "FLW", and the center layer comprised of a dimensionally stabilizing woven or non-woven material. A dimensionally stabilizing material can be any material suitable for this purpose, such as a synthetic fabric material (e.g. polyester), or any other known material used for this purpose. The total weight of the backing 135, before coating, can vary between 3 ounces per square yard and 12 ounces per square yard, with the preferred total primary backing weight at 10 ounces per square yard. The secondary backing 155 is a polymeric coating, which is applied to the primary backing and heat-cured. The polymeric coating is usually latex or urethane, with urethane being the preferred type. The coating weight varies between approximate 12 ounces per square yard and approximate 30 ounces per square yard, with 28 ounces per square yard of urethane being the preferred weight.

The infill 145 is comprised of resilient particles or a mixture of from 25 to 95 volume percent resilient particles and from 5 to 75 volume percent fine sand inter-spread among the filaments of the pile fabric 140 and on the backing 135 to a substantially uniform depth, with the preferred infill comprises of 100% rubber granules. The infill 145 may optionally comprise up to 20 volume percent of a moisture modifier such as vermiculite and calcined clay.

The depth of the infill 145 is between about ¾ inches and about 2.75 inches, with the preferred depth at about 1.0 inch. The height of yarns above the infill 145 is between about ½ inches and about ¾ inches, with the preferred height of yarn about the infill 145 at about 1.0 inch.

The drainage blanket 105 in its simplest form is a water impermeable sheet. When this structure is used, water flows along the backing 135 of the artificial turf 110 horizontally. Two sides sheets, which are extended from the same sheet of the drainage blanket or made of other materials, are necessary to prevent water from flowing on to the base 100. This design may be useful in geographic locations where rainfall is scarce. High-density and water-previous infill materials such as washing sands or heavy rubbers granules should be used to reduce the chance that the infill 145 "floats out" in unexpected large rain.

Figure 4:
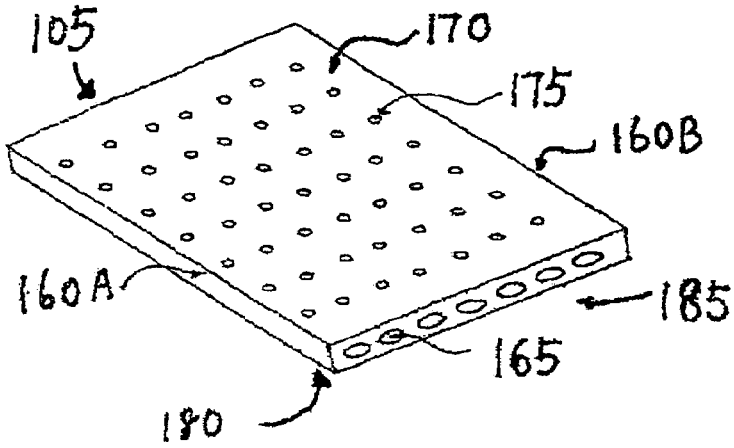
FIG. 4 is a perspective view of the drainage blanket made of a single piece of material, according to an embodiment.

FIG. 4 is a perspective view of the drainage blanket made of a single piece of material, according to an embodiment.

The drainage blanket 105 may be permeable or perforated where the base 100 remain porous or pervious. This may be desirable, for instance, when it is required that Q-values or run-off rates do not exceed existing conditions prior to construction.

The drainage blanket 105 may be made of one single piece, like a flat slab containing continuous void, which allows water to flow in at least one direction. In this case, the side sheets 160A and 160B of the members of the slab. The void within the entire slab must be continuous and sufficiently large so the drainage blanket 105 has a suitable water evacuation capacity. One example is a slab containing plural substantially parallel cylindrical, cubic or rectangular recesses 165. The top member 170 of the drainage blanket 105 contains a plurality of properly distributed receiving holes 175 of suitable size for receiving water from the artificial turf 110. The structure allows the water to flow only along the direction of the recesses 165. To allow water to flow cross individual recesses, it is necessary to remove some joint walls between individual recesses or to create a second set of cylindrical, cubic or rectangular recesses (not shown), perpendicular to the first set of the recesses 165.

The bottom member 180 of the drainage blanket 105 is waterproof. The drainage blanket 105 is molded as a single piece from one or more materials. The bottom member 180 of the drainage blanket 105 may have some properly distributed discharging holes, which might be used in some situations where the base 100 is pervious. At least one end of the drainage blanket 105 has plural exit openings 185, which allow water to discharge into the draining apparatus 120 in the field. The discharging holes may be perforated in the blanket 105 after the blanket is already molded. In other words, the holes can be punched in after manufacture of the blanket.

Note that depending upon the embodiment, the drainage blanket 105 can be impermeable, have vertical openings to only direct water vertically, can have horizontal openings to only direct water horizontally, or can have both horizontal and vertical openings to discharge water both vertically (e.g. out the bottom) and horizontally (out the side). The drainage blanket 105 may be made of many pieces of same or different materials (a composite drainage blank).

Figure 5B:
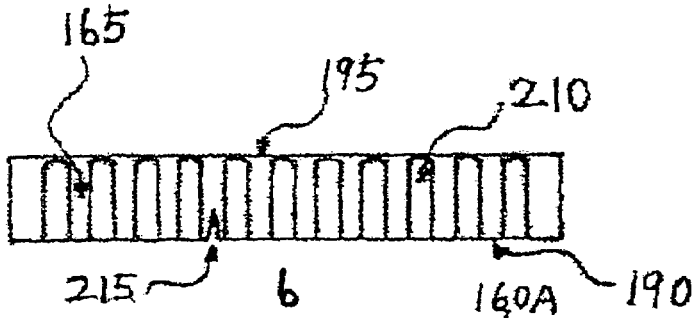
FIG. 5B is the cross-sectional view of the composite blanket of FIG. 5A along line 5—5, according to an embodiment.
Figure 5A:
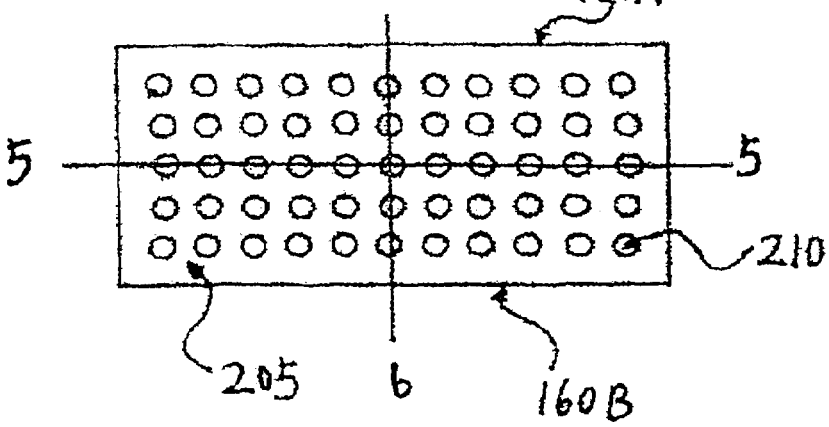
FIG. 5A is an open view of the composite drainage blanket after the top sheet is removed, according to an embodiment.

FIG. 5A is an open view of the composite drainage blanket after the top sheet is removed, according to an embodiment. FIG. 5*b* is the cross-sectional view of the composite blanket of FIG. 5A along line 5—5, according to an embodiment.

The drainage blanket 105 is made of a core 190, a top sheet 195, two side sheets 160A and 160B, and, optionally, a bottom sheet 200 (FIG. 5). The core 190 may be molded, as one single cupsated structure, using a strong, durable, and water resistant material such as high-density polyethylene. The core 190 generally has a core base 205 and a plurality of inversed cup-like studs 210 extended from the core base 205. The size, height, density (the number of studs in a unit area) of the studs 210 and their arrangement on the core base 205 depend upon the material used, the intended use of the playing field, desired shock attenuation effects, and expected the maximum rainfall intensity in the location. The studs 210 might be hollow (like inversed cups) or complete solid. The structure, density (number per unit area), arrangement, and material of the studs 210 affect the shock attenuation property.

Figure 6A:
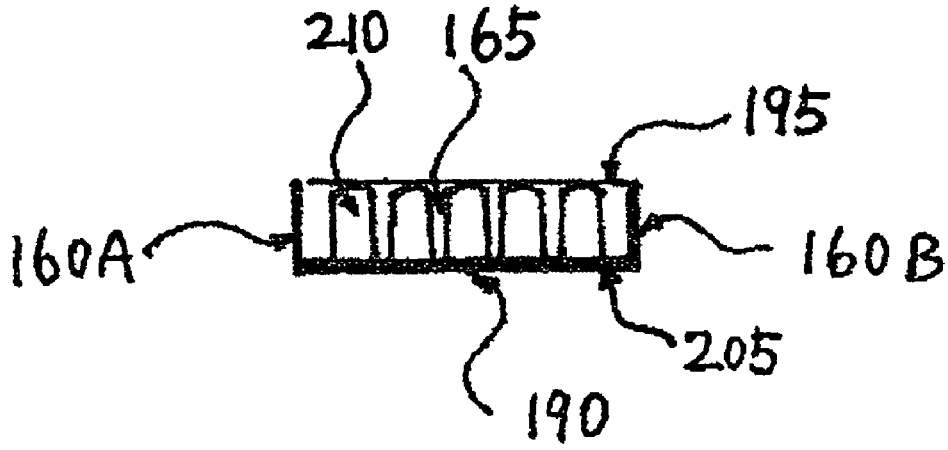
FIG. 6A, 6B and 6C shows the cross-sectional views of several versions of the composite blanket (all views are taken at the cross-sectional along line 6—6 of the drainage blanket of FIG. 5A, according to an embodiment.
Figure 6B:
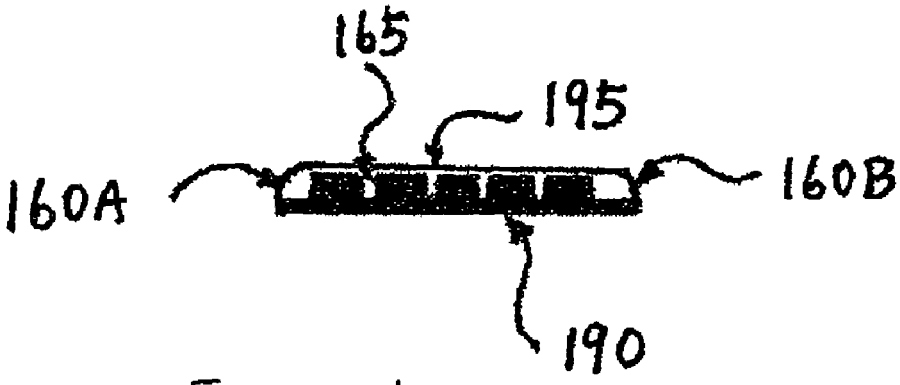
Figure 6C:
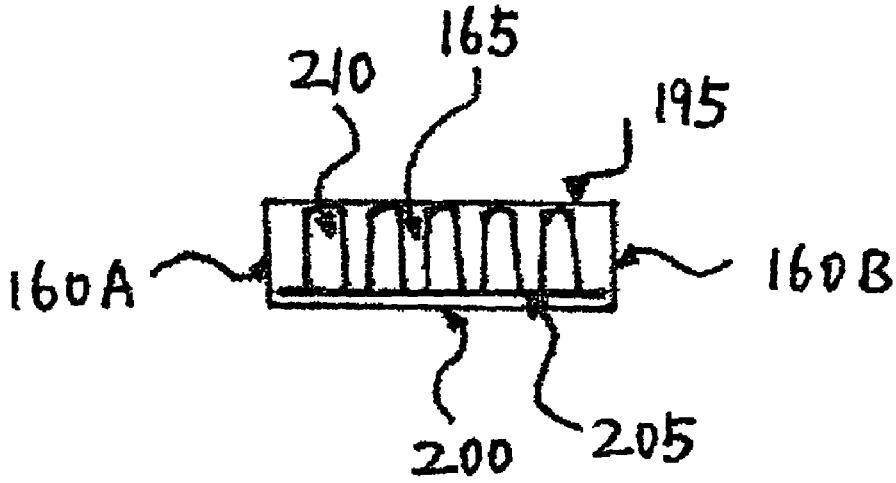

FIG. 6A, 6B, and 6C show the cross-sectional views of several versions of the composite blanket of FIG. 5A (all views are taken at the cross-sectional along the 6—6 of the drainage blanket), according to an embodiment.

A variety of methods may be used to put those components together to build the drainage blanket 105. The top sheet 195 should be permeable or perforated so that it can allow water from the artificial turf 110 to pass. The side sheets 160A and 160B should be substantially waterproof. The bottom sheet 200 should be watertight unless it is desirable to allow water to drain vertically in a limited capacity to suit special needs. The top sheet 195, in one example, can be a sheet made of permeable woven material or a perforated sheet made of a durable and impermeable material such as geotextile materials. The side sheets 160A and 160B, which join the core base 205, prevent water from getting onto the base 100 (see FIG. 6A).

In another example, the side sheets 160A and 160B may be the extended members of the core 190 and are close to or join the top sheet 195. In a further example, the top sheet 195 and the side sheets 160A and 160B may be made of one single continuous sheet joining the two sides of the core base 205 (see FIG. 6B). In this case, if the sheet is impermeable, the portion of the sheet serving as the top sheet 195 should be perforated. Finally, one single continuous sheet may be used to serve as the top sheet 195, the side sheets 160A and 160B, and the bottom sheet 200, wrapping around the core 190 (see FIG. 6C). If the sheet is impermeable, it is necessary to perforate the portion of the sheet at top. In all examples, adequate perforation may be achieved by punching a plurality of properly distributed holes of suitable size in the sheet. The perforation area per unit area must be sufficiently large to drain the water from the heaviest rainfall expected in the installation location.

The drainage blanket 105 may consist of a high-density polyethylene (HDPE) core of fused, entangled filaments sandwiches between a needle punched non-woven geotextile on one side and a head-bonded non-woven geotextile on the other side.

The drainage blanket 105 should be of sufficient compressive strength (minimum 30,000 PSF) to support construction equipment used if heavy construction equipment is used during turf installation.

Optionally, the core base 205 may have plural properly distributed holes (not shown), allowing for desirable vertical drainage. If the bottom sheet 200 is used and is impermeable, it may also have plural holes (not shown) allowing water to drain vertically. If the bottom sheet 200 is dispensed with, it is necessary for the core 190 to have two the side sheets 160A and 160B along the direction of intended water flow to prevent water from getting onto the base 100.

The drainage capacity has been tested for ProDrain™ dynamic drainage blanket using 20.00 pound per square foot overburden pressure and a gradient of 1.0%. The maximum discharge capacity was found to be 2.18 gallons per minute and per foot or 0.291 cubic feet per minute and per foot. Assuming that water travel to a drainage system is 90.00 feet, this blanket can evacuate the rainwater from steady rainfall of 2.33 inches per hour. Applying the reduction factor of 0.5 for considering the horizontal surface flow, the blanket can evacuate the rainwater from a steady rainfall of 4.66 inches per hour. Applying a safety factor of 1.05, the estimated final capacity is therefore 4.44 inches per hour.

The drainage blanket 105 of the type described tends to expand and contract with temperature changes. Thermal expansion can deform or distort the drainage blanket 105, creating a wave-like structure. As the blanket lies just beneath the artificial turf 110, the deformed or distorted drainage blanket will impact the artificial turf 110 a wave-like unnatural look. Therefore, it is necessary to incorporate expansion joints 215 in the drainage blanket 105. If the drainage blanket 105 is made of a single piece, the expansion joints 215 are plural small slits, which may be bridged by a flexible watertight tape (not shown). The joint slits are substantially evenly distributed along the drainage blanket 105. Alternatively, the expansion joints 215 may be just molding-in inversed "V" or accordions joints at the top member 170 and the bottom member 180 at suitable intervals. Because the expansion joints 215 run in the direction perpendicular to one of the main axis of the track of the artificial turf 110, the studs 210 should not be allocated along the line where the expansion joints 215 are placed. When the drainage blanket 105 expands at an elevated temperature, the two members of the drainage blanket 105 on two sides of each of the expansion joints 215 will move closer to each other, without deforming the drainage blanket 105. The inversed "V" joints are designed so that their apex will not infringe the member close to the apex at expected the highest temperature.

If the drainage blanket 105 is made of composite materials and its top is a sheet of woven materials, the expansion joints 215 are provided in the core base 205 only. In this embodiment, the expansion joints 215 are just plural small slits in the core base 205 at proper intervals. The slits may be bridged by a flexible waterproof tape. Alternatively, the expansion joints 215 may be just molding-in inversed "V" or accordions joints at the core base 205 at proper intervals. Because the expansion joints 215 run in the direction perpendicular to the one of the main axis of the track of the artificial turf 110, the studs 210 should not be allocated along the line where the expansion joints 215 are situated.

The width and frequency of the slits along the main axis of track of the artificial turf depends upon thermal expansion coefficients of the materials and anticipated changes in the field temperature in the location. If the material of the top and the bottom members of the core base 205 expands to a great degree upon a rising temperature, broader slits and more slits are needed for a given track of the artificial turf 110. Likewise, when V-joints are used for the turf system in a high temperature environment, more V-joints of large size are necessary to compensate the thermal expansion effect.

The drainage apparatus 120 may be of any type that is used in prior art. There are several way to construct the draining apparatus 120. In one of the preferred embodiments (FIG. 1), the draining apparatus 120 is a perforated pipe 125 that is laid underground near the lower edge of the base 100 and is surrounded by the washing sands or stones 120. The perforated pipe 125 is placed with required slope with its lower end connected to the main drainage system (not shown). The washing sands or stones 130 are necessary to support the drainage blanket 105 and the artificial turf 110 and also provide necessary permeability for transporting water.

In a further embodiment a plurality of the perforated pipes can be arranged vertically and can be surrounded by the washing sands or stones.

Figure 7:
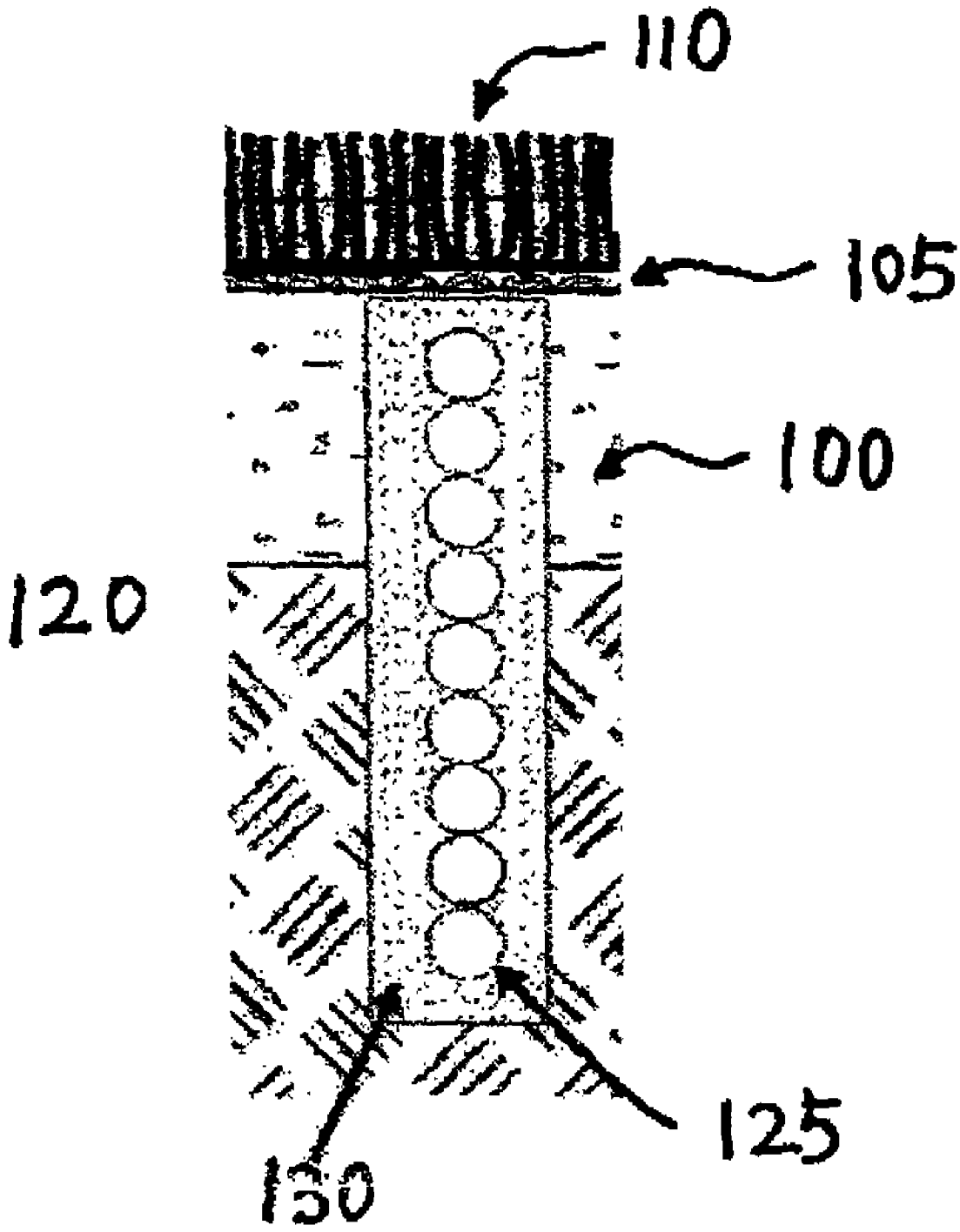
FIG. 7 is a cross-sectional view of the vertically draining artificial turf system containing collocated perforated pipes, according to an embodiment.

FIG. 7 is a cross-sectional view of the vertically draining artificial turf system containing collocated perforated pipes, according to an embodiment.

Perforated pipes 125 can be arranged vertically and operate in unison. For example, water can collect in a bottom pipe of the perforated pipes 125, but if the water exceeds the capacity of the bottom pipe, the water can then flow in the higher pipe, and so on. The vertical pipes contain an opening on the top and bottom (except for the bottom pipe which is sealed on the bottom).

To prevent water from leaking into the base 100, the draining apparatus 120 may be insulated by water impermeable materials. The perforated pipes 125 should have sufficient size for adequate drainage rate.

The base 100 of the artificial playing field may be a flat layer or slab made of stone, stone aggregates, cementations materials, limestone derivatives, or any other suitable materials. The thickness of the slab depends upon materials and structures of the base 100 and the intended use of the playing field. In addition, the base 100 may be constructed by mixing on-site soils with a soil stabilizer. A suitable soil stabilizer, for example, is polymer-enzyme solid stabilizer manufactured by G.M. Boston Co., Newport Beach, Calif. The thickness of the base 100 is in the range from about 1.0 inch to about 10 inches, with a preferred thickness in the range of 2.0–4.0 inches. The base 100 is constructed with its top surface having a slope sufficient for drainage, preferably in the range of 0.5%–1.0%, along the direction of intended water flow.

While this vertical to horizontal draining system of the present general inventive concept can be constructed over any compacted and stable materials, there is often an engineering concern for the stability of the aggregate base, should it become saturated and/or subject to high compressive forces such as from construction equipment or vehicles.

The method of constructing the base 100 using onside solids includes steps of mixing onsite soil with a soil-stabilizer, ripping, applying the mixture on the site, and grading the surface. For example, a suitable soil stabilizer is ProX-300 or polymer-enzyme solid stabilizer manufactured by G.M. Boston Co., Newport Beach, Calif. When a right stabilizer is properly infused with the soils, the base 100 is virtually impervious, with a sufficiently high compressive strength, preferably, in excess of 400 PSI.

The fastening mechanism 115 for anchoring the artificial turf 110 onto the playing field consists of a concrete footer 220 which is protruded into the ground, a poly-board nailer 225 firmly attached to the concrete footer 220, and a plurality of ramset nails 230, which are driven into the concrete footer 220 from the artificial turf 110 (see FIG. 1). In one of the preferred embodiments, the concrete footer 220 has a shape of 6×16 inches cylinder. It may be a rectangular stud or a wall-like structure, which is formed by pouring properly prepared concrete paste to the hole in the ground. The concrete footer 220 should have a sufficient dept, preferably 10 to 20 inches. When the concrete footer 220 is a wall-like structure, the poly-board nailer 225 may be a strip installed over the top surface of the concrete footer 220. When the artificial turf 110 is filled with a resilient infill material. The metal heads of the ramset nails 230 are completely covered up. The fastening mechanism 115 may be used anywhere around the artificial turf 110 so that the artificial turf 110 will be sufficiently stable horizontally. If the base 100 is a concrete slate, part of the base 100 may serve as the footer.

The horizontally draining artificial turf system may be constructed in-house playing field, typical outside athletic field, stadium, or other suitable locations.

In those exemplary embodiments of the present general inventive concept, specific components, materials, arrangements, and processes are used to describe the general inventive concept. Obvious changes, modifications, and substitutions may be made by those skilled in the art to achieve the same purpose of the general inventive concept. The exemplary embodiments are, of course, merely examples and are not intended to limit the scope of the general inventive concept. All embodiments described herein can be combined with each other. It is intended that the present general inventive concept includes all other embodiments that are within the scope of the disclosure and its equivalents.

What is claimed is:

1. An apparatus to drain turf, the apparatus comprising:

a sloped blanket positioned immediately beneath a horizontal permeable layer of said turf with a plurality of vertical openings to direct water vertically to said blanket;

said blanket comprises a plurality of horizontal openings to direct water horizontally within said blanket;

a permeable base beneath at least a portion of the blanket to allow the water from the blanket to flow vertically; and a pipe inside the base to collect and direct the water to a main drainage system.

2. An apparatus as recited in claim 1, wherein the pipe directs the water towards an area below a center of the turf.

3. An apparatus as recited in claim 1, wherein the pipe directs the water towards an area below a perimeter of the turf.

4. An apparatus as recited in claim 1, wherein the blanket comprises expansions joints.

5. An apparatus as recited in claim 1, wherein the base is a permeable stone and rocks.

6. An apparatus to drain turf, the apparatus comprising:

a sloped blanket positioned immediately beneath a horizontal permeable turf layer with a plurality of vertical openings to direct water vertically to said blanket;

a permeable stone and rock base positioned immediately beneath the blanket to allow the water from a portion of the blanket to flow vertically;

a pipe inside the base to collect the water to direct the water to a main drainage system;

a plurality of horizontal openings in a middle portion of the blanket, wherein the plurality of vertical openings on a top portion of the blanket direct water flowing from the vertical openings into the plurality of horizontal openings which direct the water horizontally to the main drainage system; and wherein the plurality of vertical openings reach the bottom of the blanket, thereby allowing the water to travel into the plurality of horizontal openings and to a plurality of vertical openings in predetermined locations on the bottom of the blanket to direct water to the main drainage system.

7. An apparatus as recited in claim 6, wherein the main drainage system is located below a center of the turf.

8. An apparatus as recited in claim 6, wherein the main drainage system is located below a perimeter of the turf.

9. An apparatus as recited in claim 7, wherein the blanket comprises expansion joints.

10. A blanket to direct water flowing vertically from an artificial turf to a horizontal water flow, the blanket comprising:

a core made of water-resistant material;

a top layer made of permeable material;

a bottom layer made of impermeable material to direct the water flowing from the artificial turf horizontally; and expansion joints located throughout the blanket.

11. A blanket as recited in claim 10, wherein the expansion joist are slits.

12. A blanket as recited in claim 11, wherein the expansion joints are accordion joints.

13. A blanket as recited in claim 11, wherein when the drainage blanket expands or contracts, the joints absorb the deformity so that the blanket as a whole is not deformed.

14. A blanket as recited in claim 11, wherein the expansion joints run in the direction perpendicular to the main axis of a track of the artificial turf.

15. An apparatus to drain artificial turf, the apparatus comprising:

means located immediately under the artificial turf for collecting rainfall beneath the artificial turf and directing said rainfall horizontally; and means at predetermined positions within the collecting means for directing the rainfall vertically to a drainage system.

16. The apparatus to drain artificial turf as recited in claim 15 wherein said collecting and directing rainfall means comprises expansions joints.

17. An artificial turf drainage system comprising:

a drainage membrane positioned immediately under said artificial turf, said membrane provides a horizontal water flow to a main drainage system;

a base located immediately under said membrane, said base stabilized by adjusting the moisture content of said base to be at approximately optimal moisture content; and means for sealing said base from water intrusion, said sealing means including quasi-impervious stone.

18. The artificial turf drainage system as recited in claim 16 wherein said drainage membrane comprises expansion joints.

19. A method of draining turf comprising the steps of:

positioning a drainage blanket immediately under said turf, said turf comprising a horizontal permeable layer with a plurality of vertical openings to direct water vertically to said blanket;

providing a plurality of horizontal openings in said blanket to direct water horizontally within said blanket;

positioning a permeable base beneath at least a portion of said blanket to allow water from said blanket to flow vertically; and providing a pipe inside said base to collect said water and direct said water to a main drainage system.

20. The method as recited in claim 19 wherein said method comprises the step of providing said drainage blanket with expansion joints.

21. A method of draining an artificial turf comprising the steps of:

positioning an impervious membrane immediately under said artificial turf, said membrane internally directing water from said turf horizontally within said membrane;

positioning a base material immediately under said membrane;

stabilizing said base material by adjusting the moisture content of said base to have approximately optimal moisture content; and Pg,24 sealing said base material from water intrusion by said base material including quasi-impervious stone.

22. The method as recited in claim 21 wherein said method comprises the step of providing said membrane with expansion joints.

* * * * *